United States Patent [19]

Allen

[11] Patent Number: 4,588,088

[45] Date of Patent: May 13, 1986

[54] CONTAINER ASSEMBLY FOR STORING TOXIC MATERIAL

[76] Inventor: Arthur A. Allen, 601 State Rd. 28 East, Williamsport, Ind. 47993

[21] Appl. No.: 457,056

[22] Filed: Jan. 10, 1983

[51] Int. Cl.[4] ..... B65D 25/14; B65D 90/08; G21F 5/00

[52] U.S. Cl. ..... 206/525; 206/524; 206/524.2; 220/444; 220/902; 250/506.1; 252/633

[58] Field of Search ..... 220/444, 466, 229, 902, 220/5 R; 29/455 R; 250/506.1, 518.1, 507.1; 206/524, 524.2, 525; 252/633

[56] References Cited

U.S. PATENT DOCUMENTS

| | | | |
|---|---|---|---|
| Re. 24,767 | 1/1960 | Simon et al. | 206/524 |
| 2,653,139 | 9/1953 | Sterling | 206/524 |
| 2,796,529 | 6/1957 | Morrison | 250/518.1 |
| 3,007,594 | 11/1961 | Wallace | 215/1 C |
| 3,027,040 | 3/1962 | Jodell et al. | 220/444 |
| 3,114,839 | 12/1963 | Peters | 250/518.1 |
| 3,148,280 | 9/1964 | Kleber et al. | 250/518.1 |
| 3,222,843 | 12/1965 | Schneider . | |
| 3,328,496 | 6/1967 | Graves | 29/455 X |
| 3,432,666 | 3/1969 | Nash et al. | 250/506.1 |
| 3,608,769 | 9/1971 | Gablin . | |
| 3,739,936 | 7/1973 | Jones, Jr. | 220/229 X |
| 3,780,309 | 12/1973 | Bochard . | |
| 3,892,032 | 7/1975 | Bagnulo | 29/455 R |
| 4,100,860 | 7/1978 | Gablin et al. | 220/444 X |
| 4,222,889 | 9/1980 | Uerpmann . | |

FOREIGN PATENT DOCUMENTS

| | | | |
|---|---|---|---|
| 1371018 | 7/1964 | France | 250/506.1 |

*Primary Examiner*—Allan N. Shoap

*Attorney, Agent, or Firm*—Woodard, Weikart, Emhardt & naughton 5n

[57] ABSTRACT

A method and container assembly for storing toxic material. An original container of toxic material is positioned within a first container and is insulated therefrom by sealant material. The first container is in turn inserted into an outside container and spaced therefrom by additional sealant material. Relief valves are positioned on the containers to allow complete filling of the space between containers with sealant material. A cap is sealingly mounted to the outside container and is fixedly secured to the first container.

6 Claims, 1 Drawing Figure

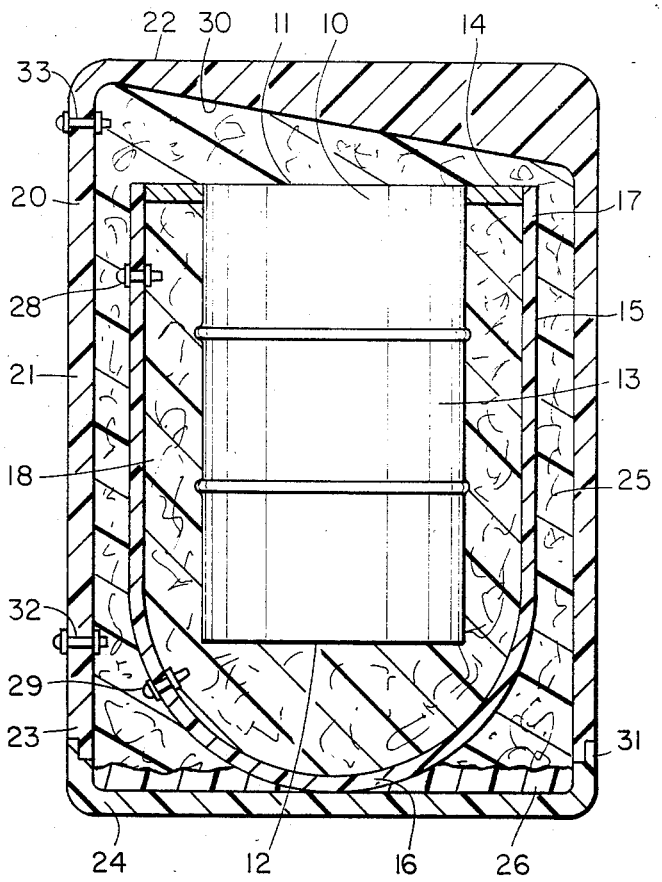
22
30
11
10
14
33
20
17
28
15
21
13
18
25
32
29
23
31
24
12
16
26

CONTAINER ASSEMBLY FOR STORING TOXIC MATERIAL

BACKGROUND OF THE INVENTION

This invention is in the field of disposing or storing toxic materials. Considerable attention has been given to protecting both the population and the environment from toxic waste. Previously, containers including 55 gallon drums having toxic material therein have simply been stored in the open or underground. The recent emphasis given to the disposal of containers of toxic materials accumulated over the years has not provided any satisfactory solution to the problem. Disclosed herein is a combination of containers and method to solve the problem of storing and disposing of containers of toxic material.

Various different types of containers have been provided for storing or shipping different products. For example, in the U.S. Pat. No. 4,222,889 issued to Uerpmann there is disclosed a method of encasing in closed sheaths a container of radioactive waste. Another insulated container for radioactive waste is shown in the U.S. Pat. No. 3,780,309 issued to Bochard which involves placing radioactive material in a double walled container. An additional double walled container is disclosed in U.S. Pat. No. 3,608,769 issued to Gablin wherein the container is to be used as a shipping container. Many shipping containers utilize solidified foam to insulate the shipped product from the exterior container such as shown in U.S. Pat. No. 3,222,843 issued to Schneider. Despite all of the many prior shipping and storage containers, a satisfactory solution to the storage or disposal of toxic material has not been devised.

SUMMARY OF THE INVENTION

One embodiment of the present invention is a method of storing a first container of toxic material comprising the steps of positioning said first container into a second container spaced therefrom by a first void, filling said first void with a sealant, positioning said second container into a third container spaced therefrom by a second void and additionally filling said second void with additional sealant.

Another embodiment of the present invention is a combination to store a container of toxic material comprising a first tubular sleeve having a closed first end and a second open end slippable around said container, first sealant material positionable between said sleeve and said container, a second tubular sleeve having a closed first end and an open second end slippable around said first tubular sleeve, second sealant material positionable between said second tubular sleeve and said first tubular sleeve; and a cap to close said second end of said second tubular sleeve.

A further embodiment of the present invention is a sealed container of toxic waste comprising an original container of toxic waste, an inside container holding said original container, a solidified sealant insulating said original container from said inside container, an outside container holding said inside container, a solidified mass insulating said outside container from said inside container.

It is an object of the present invention to provide a new and improved method for storing a container of toxic material.

A further object of the present invention is to provide a new and improved storage container for receiving an original container of toxic material wherein a high degree of protection is provided to ensure against escape of the toxic material.

Yet a further object of the present invention is to provide a method and container for storing toxic material which may be utilized in the field while requiring a minimum cost and time to assemble the container.

Related objects and advantages of the present invention will be apparent from the following description.

BRIEF DESCRIPTION OF THE DRAWING

The drawing is a cross-sectional view of the container assembly incorporating the present invention to store an original container of toxic material.

DESCRIPTION OF THE PREFERRED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawing, there is shown an original container 10 having toxic material stored therein. The container depicted in the drawing is a conventional 55 gallon drum; however, it is to be understood that the invention disclosed herein may be utilized with a variety of different types of original containers of toxic material. Container 10 includes a pair of opposite ends 11 and 12 integrally joined to a tubular side wall 13. Mounted to and surrounding end 11 is a circular and continuous ring 14 having an inside diameter equal to the outside diameter of container 10.

Container 10 and ring 14 are positioned within a second container 15 having a tubular main body with a closed first end 16 and an open opposite end 17. The inside diameter of open end 17 of container 15 is equal to the outside diameter of ring 14. A sealant material 18 fills the void existing between containers 13 and 15. Thus, sealant material 18 completely insulates container 13 from container 15 extending around end 12 of the original container as well as the side wall 13 filling all spaces existing between the two containers. Ring 14 prevents the sealant material which is eventually solidified from escaping outwardly from between the two containers.

Both containers and sealant material are further placed within an exterior container 20 having a tubular side wall 21 integrally joined to a closed end wall 22. The opposite end 23 of container 20 is sealingly closed by cap 24. End 16 of container 13 is imbedded into and securely held by a solidified compound 26 provided within cap 24. Additional sealant material 25 is positioned atop compound 26 to fill all of the remaining space existing between the inside container 15 and outside container 20 and to surround the side wall of container 15 as well as to fill the space existing between end wall 22 of the outside container and ring 14 along with end 11 of container 10.

The method of packaging container 10 first depends on whether the container 10 is positioned directly atop ground or on some other surface such as concrete, wood or asphalt. If the container 10 is positioned in a location other than immediately atop ground, then ring 14 is slipped onto the bottom end of container 10. End 11 of container 10 is originally the bottom end since the container has subsequently been inverted for the additional steps of the method disclosed hereafter. In the event the original container is placed on the ground then the first step may be eliminated and ring 14 may be discarded. The ring is produced from wax providing a somewhat flexible ring to move over and around the various horizontally extending ridges of the container. Next, the inside container 15 is positioned over and around container 10 by slipping the tubular side wall of container 15 onto container 10. Container 15 is sized to be interiorly spaced apart from container 10. In the event ring 14 is utilized, then end 17 of container 15 is slipped outwardly of and adjacent the ring.

A pair of injector nozzles 28 and 29 are mounted to the side wall of container 15 allowing a plastic sealant material to be injected into the void existing between containers 10 and 15. Valve 28 is positioned originally lower in elevation than valve 29 since containers 10 and 15 have not been inverted at this stage of the method. A molding compound is injected through valve 28 until the compound reaches a level equal to the elevation of valve 28. The compound is then allowed to set up or achieve a semi-solid state. Container 15 then may be moved slightly to determine the amount of solidification of the compound. Assuming the compound has at least partially solidified to permanently space the containers apart, the injection process may continue by injecting additional compound through valve 28 until the compound reaches the level of the upper valve 29 at which point the injection process is stopped and the lower valve 28 is closed with a conventional plug. The most recently added compound is allowed to set up to achieve at least a semi-solid or hard state. Additional compound is then injected through the upper valve assembly 29 until the entire space between the two containers is filled at which point the upper valve is closed by utilizing a conventional plug and resin assembly. Container 15 is now sealed and can be handled without fear of leaking.

Next, container 15 is inverted by placing end 16 thereof into an upwardly opening cap 24. A molding compound 26 is poured into cap 24 to bond end 16 of the container to the cap. An exterior container 20 having a tubular side wall 21 integrally joined to a top end wall 22 is next slipped over and around container 15 with the bottom edge 23 of side wall 21 being in mating engagement with the upper edge portion 31 of cap 24. A plastic molding compound 25 is preliminarily injected into a conventional valve 32 mounted to side wall 21 of the exterior container to bond containers 15 and 20 together. Once the initial compound 25 is in at least a semi-solidified state, additional molding compound is injected through valve 32 until the compound flows outwardly through an upper valve 33 also mounted to side wall 21. Valve 32 is then sealed or capped. The interior surface 30 of end 22 slopes upwardly with valve 33 being mounted to side wall 21 and positioned at the uppermost portion of surface 30. Thus, the compound 25 will not reach valve 33 until the entire space between the two containers is filled at which point valve 33 may then be capped or sealed. The resulting assembly is thus a double walled and double sealed assembly which is virtually indestructible. The assembly may be stacked on its end or on either side and may be leaned or dropped without fear of leaking.

In the event the original container 10 has a sweat or seam leak, then a fiberglass mat is sprayed with molding compound and wrapped around container 10 in a banding fashion. The mat is then allowed to cure. The original container is then further sealed in accordance with the steps previously detailed herein. In the event that either end of the original container is leaking, then a fiberglass mat sprayed with molding compound may be positioned adjacent the end prior to packaging the container in accordance with the aforementioned method.

Many variations are contemplated and included in the present invention. For example, it is desired that the sealant material located between the original container and the first inside container be less dense as compared to the sealant material between the first inside container and the outside container. It is anticipated the outer sealant material will be a thermoset compound whereas the inner sealant material will be a thermoplastic compound. Likewise, the sealant material and/or inside and outside containers may be produced from a fiberglass reinforced plastic. Other variations include placing a gel coat adjacent the outside surface of the original container and the inside container prior to injecting the thermoplastic compound.

While the invention has been illustrated and described in detail in the drawing and foregoing description, the same is to be considered as illustrative and not restrictive in character, it being understood that only the preferred embodiments have been shown and described and that all changes and modifications that come within the spirit of the invention are desired to be protected.

What is claimed is:

1. A sealed container of toxic waste comprising:

an original container of toxic waste;

an inside container holding said original container;

a solidified sealant insulating said original container from said inside container;

an outside container holding said inside container;

a solidified mass insulating said outside container from said inside container;

said solidified mass is denser than said solidified sealant;

said outside container includes an upwardly extending side wall and a top wall extending thereacross, said top has an interior surface slanting upwardly from said side wall, said container further includes a relief valve positioned adjacent the uppermost portion of said surface.

2. A combination to store a container of toxic material comprising;

a first sleeve having a closed end and an open end slippable around said container;

first sealant material positionable between said sleeve and said container;

a second sleeve having a closed end and an open end slippable around said first sleeve;

second sealant material positionable between said second sleeve and said first sleeve;

a cap to close said open end of said second sleeve;

a sealant relief valve mounted to said second sleeve to allow said second sealant material to flow therethrough and wherein said second sleeve includes a vertical tubular side wall and a top wall extending across and atop said side wall, said top wall has an interior surface slanting upwardly from said side wall with said valve located adjacent the uppermost portion of said surface and with said second sealant material filled thereto.

3. A combination to store a container of toxic material comprising:

a first tubular sleeve having a closed end and an open end slippable around said container;

first sealant material positionable between said sleeve and said container;

a second tubular sleeve having a closed end and an open end slippable around said first tubular sleeve;

second sealant material positionable between said second tubular sleeve and said first tubular sleeve;

a cap to close said open end of said second tubular sleeve;

sealant relief valves mounted to said first tubular sleeve and said second tubular sleeve to allow said first sealant and second sealant to flow therethrough; and wherein:

said second tubular sleeve includes a vertical tubular side wall and a top wall extending across and atop said side wall, said top wall has an interior surface slanting upwardly from said side wall with one of said valves located adjacent the uppermost portion of said surface and with said second sealant material filled thereto.

4. The combination of claim 3 wherein said cap and said open end of said second tubular sleeve include mating edge portions.

5. The combination of claim 4 and further comprising a ring mountable to said container at the end thereof and sized to fit inside of and against said first tubular sleeve limiting flow of said first sealant material.

6. The combination of claim 5 wherein said open end of said first tubular sleeve is positioned adjacent said closed end of said second tubular sleeve, and said closed end of said first tubular sleeve is positioned adjacent said cap.

* * * * *